United States Patent [19]

Hurley

[11] Patent Number: 4,767,915

[45] Date of Patent: Aug. 30, 1988

[54] SOLID PLATE PLUG-IN HEATING ELEMENT

[75] Inventor: James E. Hurley, Allentown, Pa.

[73] Assignee: Raytheon Company, Lexington, Mass.

[21] Appl. No.: 31,814

[22] Filed: Mar. 30, 1987

[51] Int. Cl.[4] ..... H05B 3/70

[52] U.S. Cl. ..... 219/459; 219/457; 219/463; 219/467

[58] Field of Search ..... 219/459, 458, 443, 457, 219/461, 462, 464, 467, 451, 463

[56] References Cited

U.S. PATENT DOCUMENTS

| | | | |
|---|---|---|---|
| 2,101,110 | 12/1937 | Thornton, Jr. | 219/445 |
| 2,260,165 | 10/1941 | Calhoun | 219/461 |
| 3,110,795 | 11/1963 | Bremer | 219/464 |
| 3,327,095 | 6/1967 | Hanson | 219/451 |
| 3,838,249 | 9/1974 | Detterbeck | 219/463 |
| 4,467,181 | 8/1984 | Fischer et al. | 219/458 |

FOREIGN PATENT DOCUMENTS

| | | | |
|---|---|---|---|
| 264991 | 2/1927 | United Kingdom | 219/459 |

OTHER PUBLICATIONS

Chromalox Electric Range Units, Bulletin RU-149 (pp. 9-25), Edwin L. Wiegand Co., 1949.

*Primary Examiner*—E. A. Goldberg
*Assistant Examiner*—Teresa J. Walberg
*Attorney, Agent, or Firm*—William R. Clark; Richard M. Sharkansky

[57] ABSTRACT

A solid plate plug-in top surface heating element which is interchangeable with a shielded spiral wire surface heating element. Rigid conductors connect to the ends of the resistive wire heating element on the underside of the solid plate top disk. The rigid conductors are secured in horizontal alignment by a bracket to which both are connected, and they extend outwardly in the horizontal plane. A pan covers the underside of the solid plate top disk and insulated portions of the rigid conductors pass through two respective holes in the side of the pan. The conductor connecting bracket is affixed to the pan and the insulated portions of the conductors. The distal ends of the conductors have terminals adapted for mating with a plug-in receptacle. The grounding bolt of the solid plate top disk is connected to the pan and a grounding bracket runs from the pan and surrounds the distal portions of the conductors to provide a terminal for mating with the clip ground of the receptacle.

10 Claims, 7 Drawing Sheets

SOLID PLATE PLUG-IN HEATING ELEMENT

BACKGROUND OF THE INVENTION

For some time, solid-plate electric surface heating elements have been in wide usage in Europe and, more recently, they have gained some consumer acceptance in the United States. These elements have been referred to by a variety of names such as, for example, solid-surface electric heating elements, sealed electric heating elements, and Euro-style or European range top elements. One advantage of these elements is that they are sealed to the cooktop and have a solid surface so that spill-overs don't run underneath the cook top. Also, some like the appearance of the solid plate elements.

Generally, a solid plate element has a substantially flat cast iron top disk or plate with a trim ring for supporting the element from the cook top or main top onto which it is sealed. Extending downwardly from the underside of the top disk is a cylindrical casing which encloses a ceramic layer in which resistive electric heating coils are embedded. Encasing the lower end of the cylindrical casing is a bottom metal jacket or cover. Extending axially downwardly from the underside of the top disk is a grounding bolt which inserts through an aperture in the bottom jacket. A nut is tightened down on the bolt to hold the jacket in place.

In the prior art, a bracket is attached to the underside of the jacket and extends radially. A ceramic insulator terminal is then mounted on the outward end of the bracket. Uninsulated wire leads which are connected to one or more of the embedded resistive electric heating coils are fed through the bottom jacket via a ceramic block insulator and are run out to the ceramic insulator terminal. The first step for installing the solid plate elements in a range top has been to connect the power lines from the control unit to the ceramic insulator terminal and tightening down connecting screws to securely couple them to the respective wire leads. The solid-plate elements are then mounted within a cook top box by inserting them through respective apertures in the top platform where they are supported by the trim rings. The grounding bolts and locating posts extend through respective apertures in the floor of the cook top box or compartment and nuts are tightened down to securely fix them in place. Solid plate surface heating elements have also been mounted in plug-in cartridges that encase at least two elements.

The above-described range configuration and fabrication method have significant drawbacks for range manufacturers. First, if the range manufacturer is also in the business of manufacturing electric ranges with the much more common open coil surface heating elements that have a shielded spiral wire, the cook tops or main tops are generally not interchangeable parts. More specifically, with a range having shielded spiral wire or open coil surface elements, it is desirable to have a hinged lift-up cook top to permit fast and easy clean up of spill-overs. However, with the solid-plate elements, the cook top must be a box-type structure because the unshielded wires must be securely encased and the elements must be bolted in place and grounded.

Another drawback is that the initial fabrication and later maintenance for a solid plate element are much more complicated than for an open coil heating element. For example, rather than the consumer being able to merely lift a failed element out from the top and replace it as is done with an open coil or shielded spiral wire surface element, a service call is generally required with a solid plate element because it must be unbolted from the bottom and rewired. It is also a drawback that the open coil and solid plate surface elements are not interchangeable; some consumers who already own a range with one type of surface heating element may wish to switch to the other type.

Solid plate heating elements have also exhibited other disadvantages in the above-described prior art configuration. First, because the solid plate heating elements have been securely attached to the cook top or main top on which they are supported, the thermal conductivity from the solid plate heating element to the adjacent cook top has been relatively high and, as a result, cook tops have gotten very hot such as, for example, 270° F. Another disadvantage is that solid plate heating elements generally have more mass than open coil heating elements, and therefore they are slower to heat up. For example, a solid plate heating element may take 30% longer to heat up than an equivalent open coil heating element. In fact, one important reason for originally using the open coil element was that it had relatively low mass and therefore heated up quickly. Thus, they were called high speed elements.

SUMMARY OF THE INVENTION

It is an object of the invention to provide a solid plate plug-in heating element.

Another object is to provide a solid plate surface electric heating element that is interchangeable with a conventional shielded spiral wire heating element. It is also an object that the solid plate heating element be able to be plugged in and removed from a conventional shielded spiral surface heating element receptacle having an external spring clip grounding terminal.

Still another object of the invention is to provide a grounding path from a solid plate heating element to a spring clip grounding terminal of a two-conductor receptacle.

Another object is to provide a single plug-in solid plate heating element wherein, in a plugged in condition, all wires are encased.

These and other objects are provided with the invention which defines a solid plate plug-in surface heating element adapted for interchangeably plugging into a receptacle for a single open coil plug-in surface heating element, comprising a solid plate top, a resistive heating wire positioned under the solid plate top for generating heat for conduction through the solid plate top, a pan mounted to the underside of the solid plate top for shielding the ends of the resistive heating wire, and a pair of conductors extending outwardly from the pan in substantially a horizontal plane, the inward ends of the pair of conductors respectively being electrically connected to the ends of the resistive heating wire, each of the outward ends of the pair of conductors having a plug in terminal adapted for plugging into a receptacle for a single open coil plug-in surface heating element. It may be preferable that the element further comprise means for grounding the solid plate top to an external grounding clip terminal on the receptacle. Also, the grounding means may comprise a grounding bolt coupled from the solid plate top to the pan and a bracket extending from the pan to the grounding clip terminal on the receptacle. Further, the pan may be mounted to the solid plate top using a nut engaging the grounding bolt.

The invention further defines a solid plate electric surface heating element adapted for plugging into a conventional receptacle for a shielded spiral wire surface heating element, comprising a solid plate top disk having a grounding bolt extending downwardly from the underside, a resistive electric heating wire attached under the solid plate top disk to provide heat for conduction through the solid plate top disk, a pan having a bottom and a side wall with at least one aperture, means engaging the grounding post for affixing the pan covering the underside of the solid plate top disk, the affixing means electrically connecting the pan to the grounding post, first and second electrical conductors connected to the ends of the resistive heating wire, the conductors extending through the at least one aperture in the pan and being electrically insulated from the pan, the first and second conductors having distal terminals adapted for plugging into the receptacle, and means for grounding the pan to the receptacle. It may be preferable that the grounding means comprise a bracket having one end attached to the pan and a distal end having a terminal plate with two holes through which the first and second conductors pass. Further, it may be preferable that the engaging means comprise an aperture in the pan through which the post extends and a nut tightened on the post for securing the pan against the solid plate top disk. Also, it may be preferable that the heating element further comprise a mounting plate having two holes through which the conductors are inserted and securely clamped in substantially parallel horizontal alignment, the mounting plate being affixed to the side wall of the pan adjacent the at least one aperture for securing the outward extension of the conductors.

The invention may also be practiced by a solid plate electric surface heating element adapted for plugging into a shielded spiral wire surface element receptacle having a spring clip grounding terminal comprising a solid plate top disk having a grounding bolt extending downwardly from the underside thereof, a resistive heating wire embedded in a ceramic layer bonded to the underside of the solid plate top disk for generating heat for conduction through the solid plate top disk, a pan having a bottom and a side wall with first and second apertures, means for mounting the pan under the solid plate top disk encasing the resistive heating wire, the pan being electrically connected to the grounding bolt, first and second rigid electrical conductors connected to the resistive heating wire and respectively extending through the first and second apertures, the conductors being electrically insulated from the pan and having distal terminals adapted for plugging into the receptacle, and means comprising a bracket attached to the pan for electrically connecting the pan to the spring clip grounding terminal of the receptacle.

The invention further defines a solid plate electric surface heating element adapted for plugging into the receptacle of a shielded spiral wire surface element having an external spring clip grounding terminal, comprising a solid plate top disk having a peripheral grounding rim support and a grounding bolt extending downwardly from the underside thereof, a resistive heating wire embedded in ceramic bonded to the underside of the top disk for providing heat for conduction through the solid plate top disk, a metal jacket covering the bottom of the ceramic on the underside of the disk, the jacket having an insulated port for passing the ends of the resistive heating wire, a terminal block for receiving the ends of the wire, a pan having a bottom with a hole for receiving the grounding bolt and a side wall with first and second apertures, the pan being mounted under the top disk and encasing the terminal block, the pan being electrically and mechanically connected to the top disk by a nut tightened up on the grounding bolt, first and second rigid electrical conductors electrically connected to the respective ends of the resistive heating wire at the terminal block, the conductors respectively extending through the first and second apertures in the wall of the pan and having plug-in terminals adapted for plugging into the receptacle, a portion of the first and second electrical conductors having a coating of electrical insulation encased in a metal sleeve, means for holding the conductors substantially parallel and for securing the conductors to the pan, the holding and securing means comprising a metal plate having first and second apertures through which the metal sleeves of the respective first and second conductors are inserted, the metal plate being affixed to the pan, and means for electrically connecting the pan to the external spring clip grounding terminal of the receptacle. Preferably, the heating element further comprises a trim ring secured between the rim of the top disk and the pan for supporting the heating element.

The invention may be practiced using a surface heating apparatus comprising a surface cook top having at least one heating element receiving aperture and a receptacle mounted under the cook top adjacent to the aperture, the receptacle having two plug-in terminals with external grounding clip terminal, and a solid plate plug-in surface heating element removably seated on a region of the cook top peripheral to the aperture, the solid plate plug-in surface heating element having two extending terminals respectively engaging the two plug-in terminals of the receptacle and a ground terminal removably engaging the grounding clip terminal of the receptacle.

The invention further defines a surface heating apparatus comprising a cook top having first and second apertures for receiving heating elements, each of the apertures having a corresponding single element plug-in receptacle mounted adjacent thereto, and first and second solid plate surface heating elements respectively corresponding to the first and second apertures, each of the first and second solid plate surface heating elements being removably seated on a region of the cook top peripherally around its corresponding aperture, each of the first and second solid plate surface heating elements having plug-in terminals extending therefrom and removably engaging the single element plug-in receptacle adjacent thereto where the first and second solid plate heating elements can be removed and replaced.

The invention further defines a surface heating apparatus comprising a cook top having a plurality of openings each having a corresponding single element plug-in receptacle mounted adjacent thereto, and a like plurality of solid plate surface heating elements each having a one-to-one correspondence with the openings and the receptacles, each one of the solid plate heating elements being removably seated on the cook top peripherally around its corresponding opening, each of the solid plate surface heating elements having plug-in terminals connected to its corresponding plug-in receptacle.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENT

Figure 1:
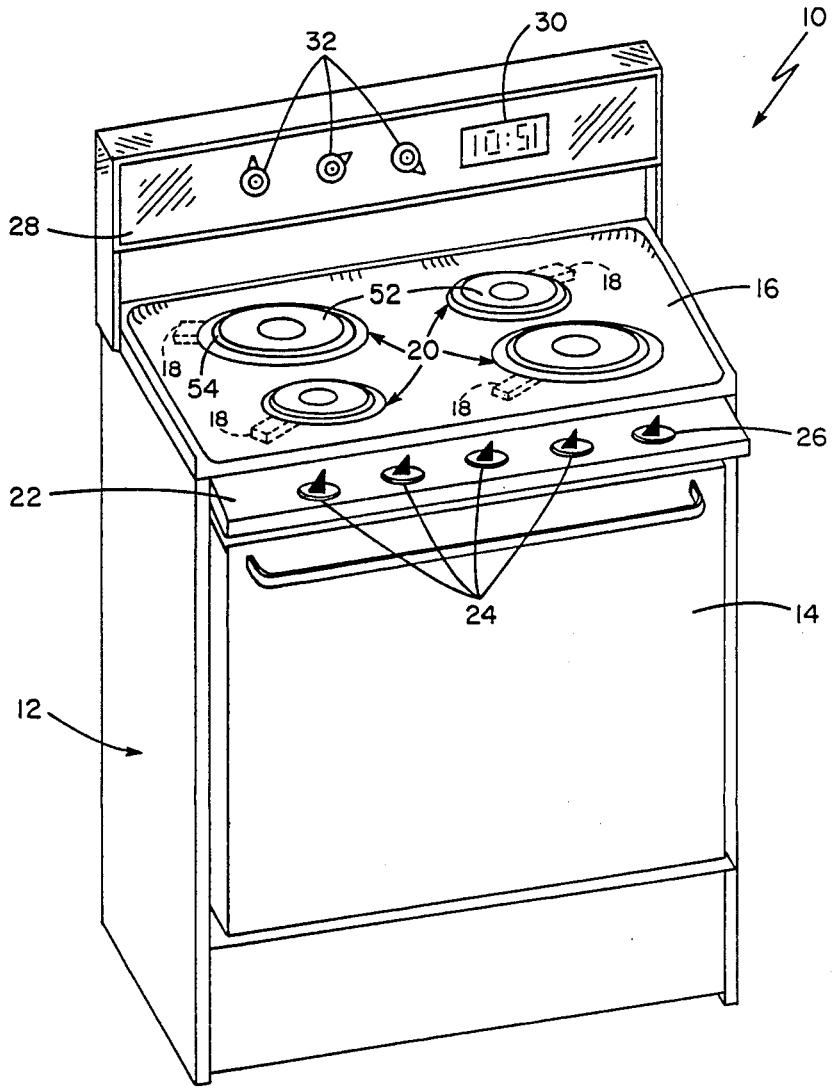
FIG. 1 is a front perspective view of an electric range embodying the inventive plug-in solid plate surface heating elements.

Referring to FIG. 1, a domestic electric range 10 is shown. Although the illustrated range 10 is of a free-standing type, the invention can be used to advantage with other types of surface cooking units, such as a drop-in range, or a built-in cook top. Range 10 here includes a lower boxlike oven 12, typically formed of sheet metal panels. The housing of oven 12 includes an oven door 14.

Cook top 16 or main top defines a conventional horizontal cooking platform as has been used in the past to mount shielded spiral surface cooking elements. More specifically, as will be described later herein, the underside of cook top 16 includes four conventional surface element receptacles 18 with grounding terminals 108 (FIG. 8) used heretofor to receive the plug-in terminals of shielded spiral surface cooking elements. In accordance with the invention as will be described in detail later herein, four plug-in solid plate surface electric heating elements 20 are seated on cook top 16. Control panel 22 includes a plurality of control knobs 24 respectively corresponding to surface elements 20, and control knob 26 for controlling oven 12. Back panel 28 includes a clock 30 and timer controls 32.

Figure 2:
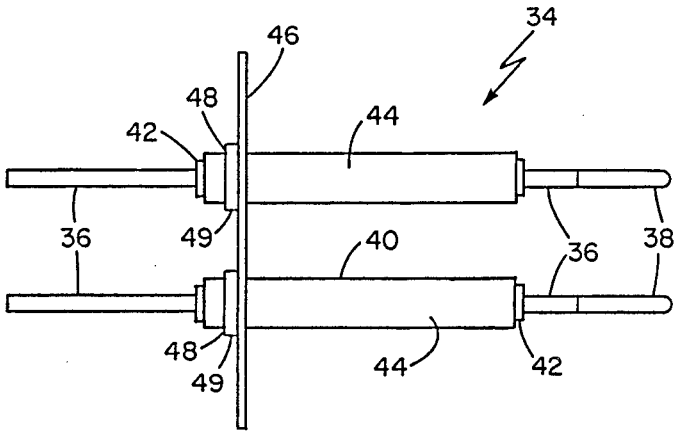
FIG. 2 is a top view of the terminal adaptor used to couple to a conventional receptacle.
Figure 3:
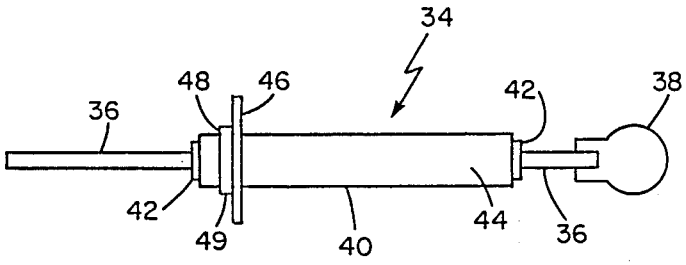
FIG. 3 is a side view of the adaptor of FIG. 2.
Figure 4:
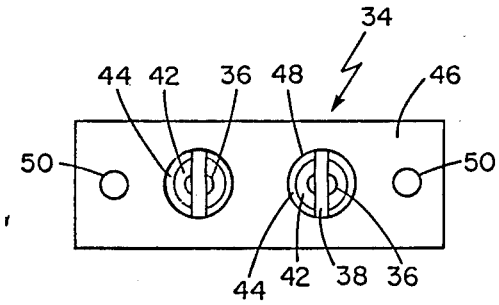
FIG. 4 is a front view of the adaptor of FIG. 2.

Referring to FIGS. 2–4, there are respectively shown top, side, and end views of plug-in adaptor 34. Adaptor 34 includes two rigid conductors 36 or wires each having a terminal blade 38 connected to one end; in an alternate embodiment to blade 38, conductors 36 could have a loop formed on the end. However, it is important that terminals 38 be adapted for mating with a two terminal receptacle such as conventionally used with shielded spiral wire surface heating elements. A central region 40 of each wire is coaxially surrounded by insulator 42 encased in a metallic sleeve 44. It may be preferable that insulator 42 be magnesium oxide instead of some other dielectric insulator because it is unlikely to crack. Conductors 36 are parallelly affixed in substantially parallel alignment by cross mounting plate 46 or brace which has two holes 48 through which sleeves 44 insert. Holes 48 have a collar 49 which is crimped down on sleeves 44 to provide secure attachment. Mounting plate 46 also has two screw holes 50 which will be described later.

Figure 5:
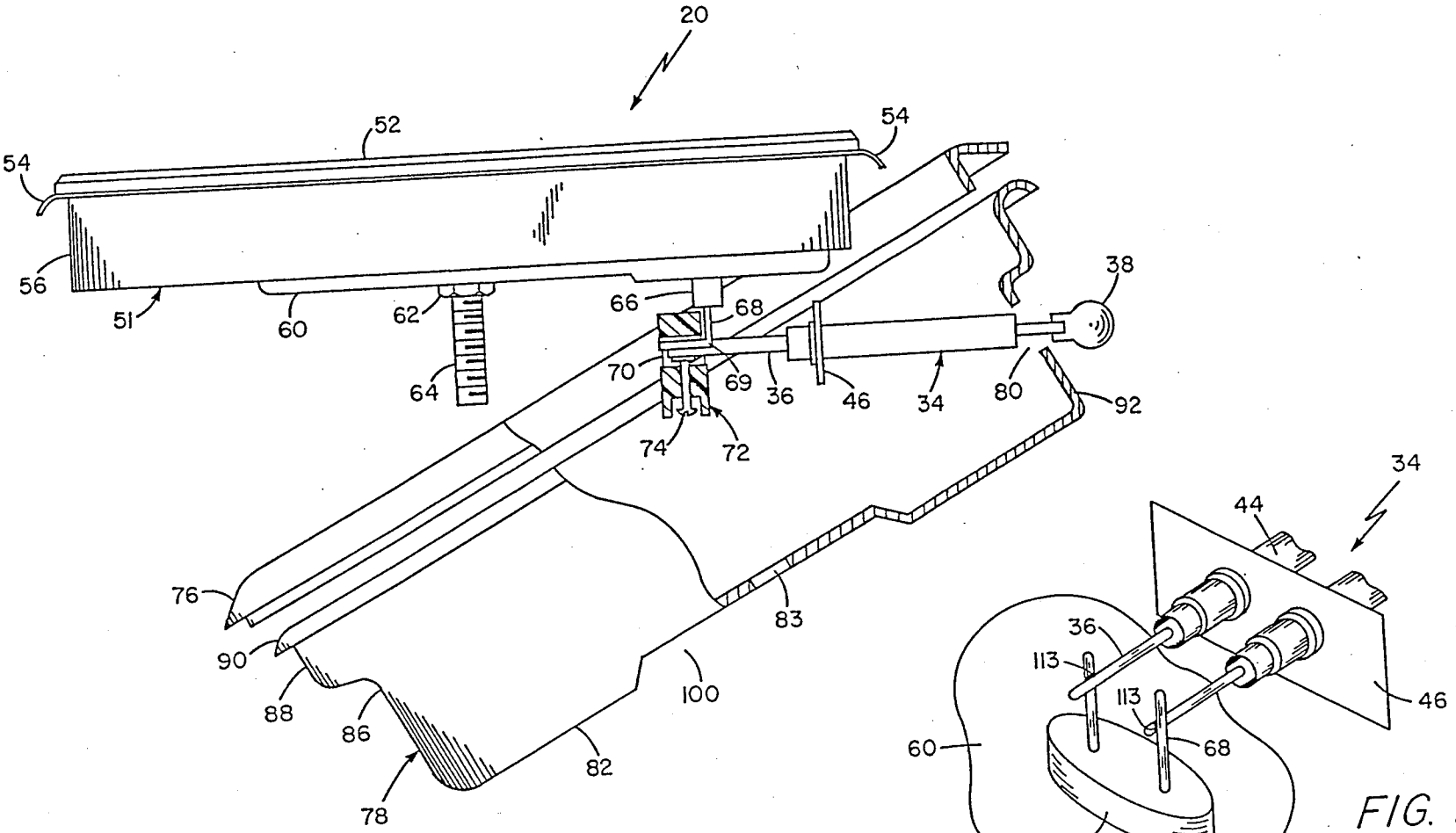
FIG. 5 is a view of an intermediate assembly step of the solid plate plug-in heating element.

Referring to FIG. 5, an intermediate assembly step of plug-in solid plate surface electric heating element 20 is shown. Solid plate electric heating element 20 is part of a commercially available unit, here including a cast iron top disk 52, trim ring support 54, and a downwardly extending cylindrical casing 56. Adjacent to top disk 52 inside cylindrical casing 56 is a ceramic layer (not shown) in which one or more coiled resistive heating wires 58*a–c* (FIG. 10) are embedded. As is well known, when the resistive heating wires 58*a–c* are energized by electric current, the generated heat conducts through top disk 52 to a cooking utensil (not shown) resting thereon. The lower end of cylindrical casing 56 is covered by a metal jacket 60 which is held in place by a nut 62 tightened down on a bolt 64 which is connected to top disk 52. Bolt 64 also functions as an electrical ground.

A ceramic insulator 66 extends through an aperture in jacket 60 and provides an electrically insulated passageway for the unshielded wire ends 68 or leads from resistive heating wires 58*a–c*. Wires 68, which heretofore ran to a terminal block on the distal end of a bracket, were cut off and securely attached to respective plug-in adaptor 34 by suitable means, here shown to be conventional ceramic block terminal 72 or housing. As shown in FIG. 5, wire leads 68 have a right angle inward bend 69 and insert through respective conforming channels 70 in ceramic block terminal 72 or housing. In fabrication, conductors 36 of adaptor 34 are also inserted through channels 70 of block terminal 72 and screws 74 are tightened down to provide a secure mechanical and electrical connection between conductors 36 and wire leads 68.

Figure 7:
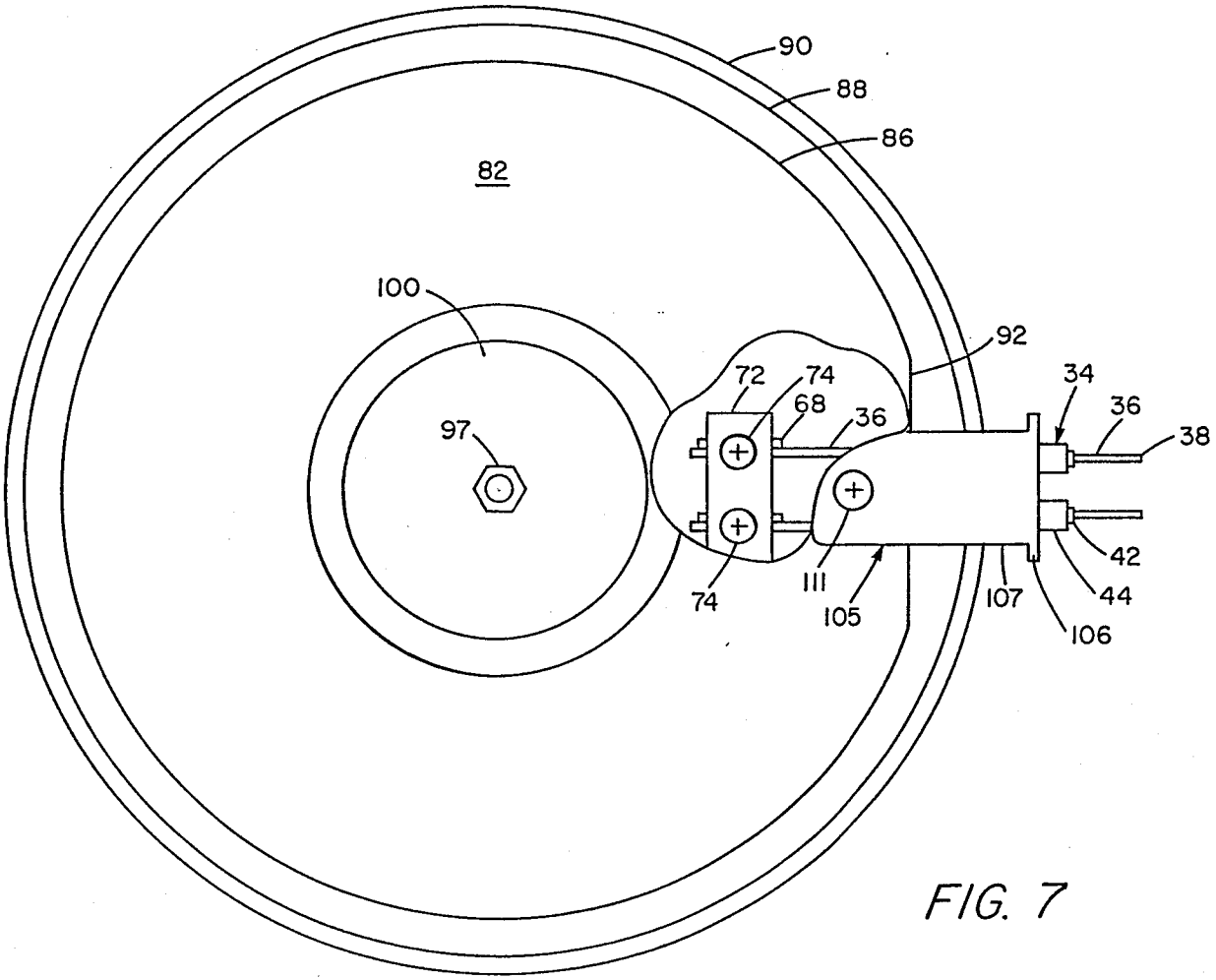
FIG. 7 is a partially broken away bottom view of the solid plate plug-in heating element.
Figure 6:
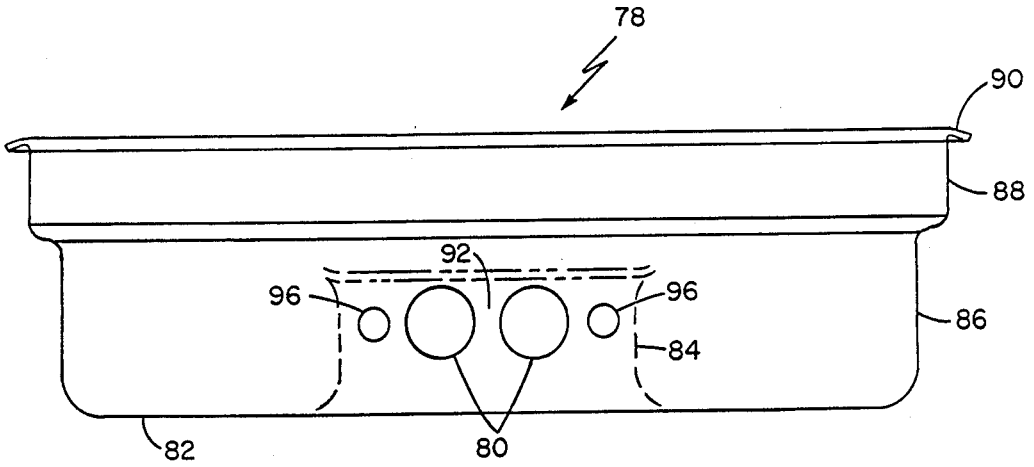
FIG. 6 is a front view of the pan.

In the next step of fabrication, trim ring 76 is slipped over adaptor 34 and pan 78 or housing is positioned as shown in FIG. 5 with conductors 36 of adaptor 34 extending through holes 80 of pan 78. More specifically, with reference to FIGS. 6 and 7, which respectively show side and partially broken away bottom views of pan 78, pan 78 has a substantially circular bottom 82 which has a small truncated section 84, a lower wall section 86, an upper wall section 88 and a rim 90. Lower wall section 86 has a flat region 92 in which are located pairs of holes 80 and pairs of holes 96. Holes 80 provide passageways for conductor wires or conductors 36 to be routed from the interior of pan 78 to plug-in receptacle 18. Therefore, each of holes 80 is large enough to receive terminal blades 38 and metallic sleeves 44. With each of conductors 36 extending through one of holes 80, pan 78 and trim ring 76 are rotated towards a horizontal alignment to coincide with heating element 20 and moved so that their centers align. Pan 78 has a central aperture 83 which aligns with and receives grounding bolt 64.

Figure 8:
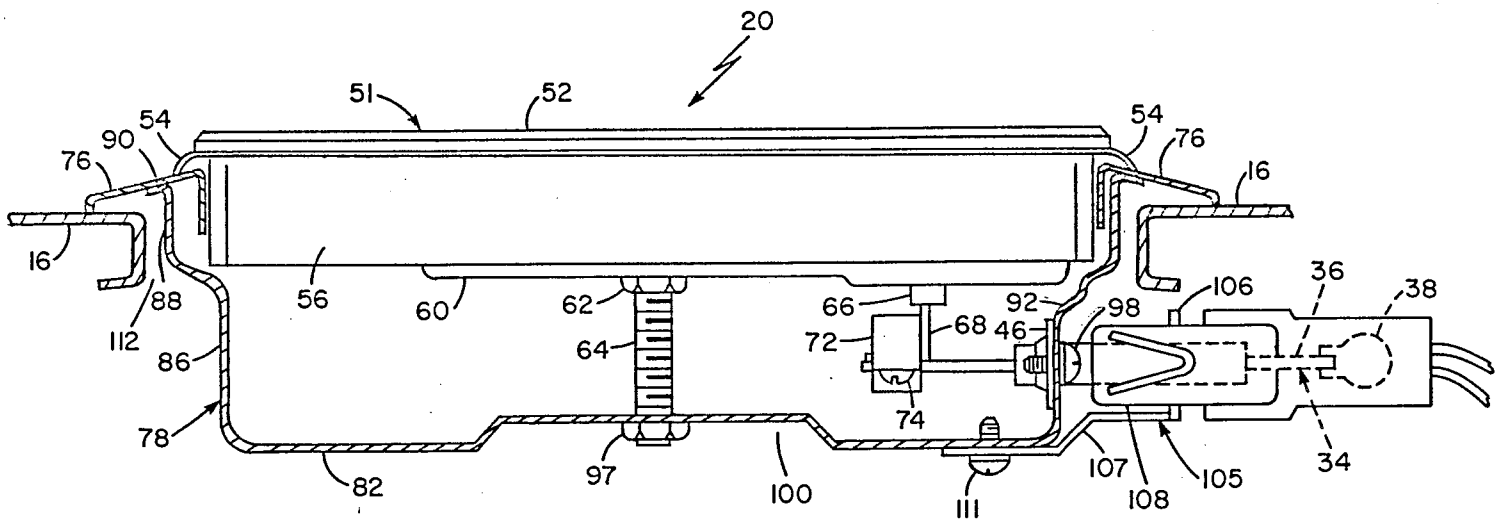
FIG. 8 is a sectioned side view of the solid plate plug-in heating element connected for operation.
Figure 9:
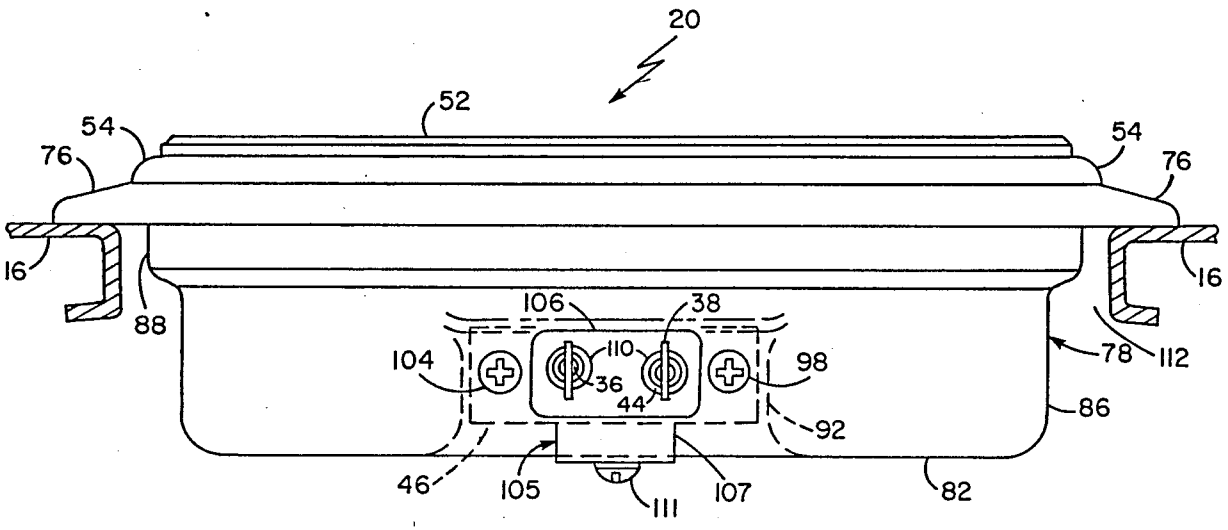
FIG. 9 is a front view of the solid plate plug-in heating element after final assembly.

Referring to FIGS. 8 and 9, front and side views of the final assembly of a plug-in solid plate surface electric heating element 20 are respectively shown. As can be seen from the assembly step previously described, pan 78 is pushed upwardly until trim ring 76 contacts and seats against the underside of trim ring support 54, and rim 90 of pan 78 is positioned in engagement with the underside of trim ring 76. A nut 97 is then tightened up onto grounding bolt 64 to securely hold the plug-in solid plate element 20 together. The upward force supplied by nut 97 tightly seals rim 90 against trim ring 76 and trim ring 76 against trim ring support 54. Preferably, the bottom 82 of pan 78 has a central recess 100 so that bolt 64 does not protrude below the bottom profile of pan 78.

The distance from plate 46 to block terminal 72 is selected so that plate 46 contacts the inside surface of flat region 92. Also, holes 96 on flat region 92 are located so as to align with screw holes 50 of plate 46. The next step in the assembly process is to insert screws 98 through holes 96 and screw them into screw holes 50 of cross mounting plate 46 as shown best in FIG. 8. With the above described arrangement, conductors 36 are electrically connected to the ends of resistive heating wires 58*a–c* at terminal block 72, and conductors 36 rigidly and securely extend parallel in the horizontal direction through holes 80 of pan 78 to respective terminal blades 38 with the passage through holes 80 being electrically insulated from pan 78 by insulators 42.

Still referring to FIGS. 8 and 9, the final assembly step is to mount grounding bracket 105 which has a grounding terminal 106 which engages the conventional external spring clip grounding terminal 108 of plug-in receptacle 18. Grounding terminal 106 is a substantially rectangular metal plate with two apertures 110 for receiving metallic sleeves 44. Because the vertical length of terminal blades 38 may be longer than the diameter of metallic sleeves 44, it may be preferable to notch the top and bottom of apertures 110 so that grounding terminal 106 may be slipped over terminal blades 38 and still have a relatively snug fit around metallic sleeves 44, even though there is no need for electrical contact between grounding terminal 106 and metallic sleeves 44 in this described embodiment. From grounding terminal 106, grounding bracket 105 extends horizontally to a declined section 107 and then horizontally again to screw 111 which mechanically and electrically connects grounding bracket 105 to the bottom 82 of pan 78.

Still referring to FIG. 8, plug-in solid plate surface electric heating element 20 is shown installed on a conventional cook top 16 adapted for receiving shielded spiral wire or open coil surface elements which are conventional plug-in units. More specifically, trim ring 76 has a diameter so as to support heating element 20 on the peripheral region of one of the standard sizes of conventional cook top openings 112. Underneath cook top 16, plug-in receptacle 18 is mounted by conventional and suitable means (not shown) which may, for example, be by screwing its mounting bracket to the under lip of the cook top opening 112, or by screwing it to the floor of the cook top compartment. It can be seen that the unshielded wire leads 68 are encased by pan 78. The only portion of the plug-in adaptor 34 which is uninsulated or unshielded outside of pan 78 is the portion near and including terminal 38 which is completely within receptacle 18 during operation. Therefore, there are no exposed wires and heating element 20 can be used with a main top or cook top 16 that can be lifted up.

Figure 10:
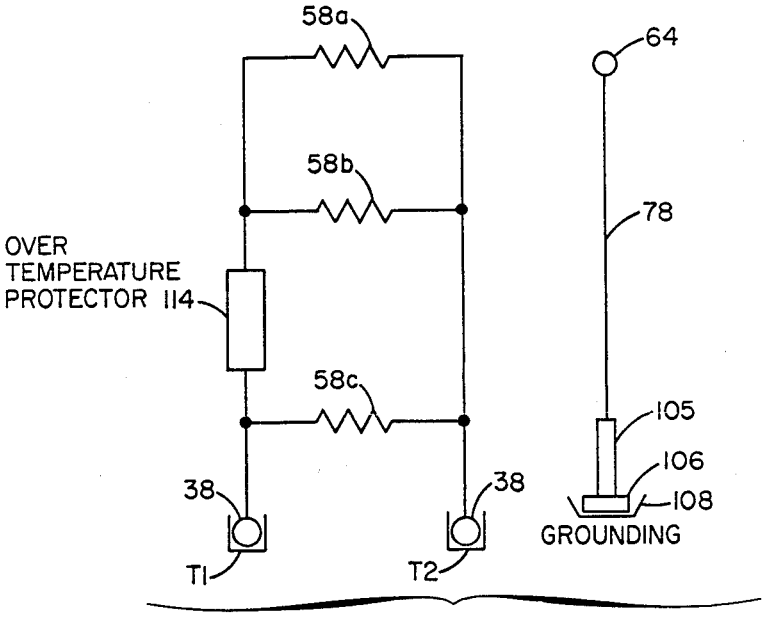
FIG. 10 is a schematic diagram of the solid plate plug-in heating element.

Referring to FIG. 10 which shows a schematic diagram of plug-in solid plate surface electric heating element 20, and still referring to FIG. 8, terminal blades 38 insert in conventional terminals T1 and T2 of plug-in receptacle 18. Upon energizing terminals T1 and T2 using the corresponding control knob 24, current flows through conductors 36 to the ends of resistive heating wires 58, here shown in FIG. 10 as three parallel resistors 58*a–c*. Conventional over temperature protector 114, which may open at approximately 600° C., deactivates resistive elements 58*a* and 58*b* at that temperature thereby leaving resistive element 58*c* as the only active device. The grounding path from grounding bolt 64 is through pan 78 and grounding bracket 105 to the grounding terminal 108 of plug-in receptacle 18.

Still referring to FIG. 8, it can be seen that plug-in solid plate surface electric heating element 20 is a plug-in unit and accordingly can easily be removed and replaced from plug-in receptacle 18. Accordingly, in accordance with the invention, heating element 20 is interchangeable with conventional shielded spiral surface electric heating elements. This means that a consumer who already owns a conventional range using shielded spiral surface electric heating elements can readily convert to solid plate elements. Further, maintenance of the solid plate heating element is greatly simplified because a failed unit can easily be removed and replaced. Further, for the manufacturer, it means that the parts such as cook top 16 are interchangeable between shielded spiral and solid plate ranges.

In accordance with the invention, plug-in solid plate element 20 does not heat the adjacent cook top 16 up to such high temperatures as the prior art solid plate configuration where the elements were bolted to the cook top 16. More specifically, a plug-in solid plate element 20 might raise the temperature of the adjacent cook top 16 to approximately 170° F. which may, for example, be approximately 100° F. less than the prior art configuration under substantially equivalent conditions. One reason for having less heat transfer to the cook top 16 with a plug-in solid plate heating element 20 is that there is not such a tight contact between the two because the plug-in solid plate heating element 20 is not tightened on a bolt to the cook top 16. Another reason is that trim ring 76 serves as an intermediate heat conduction path and it also increases the circumference of contact to the cook top 16.

A further advantage of having a plug-in solid plate heating element that is interchangeable with open coil heating elements is that a consumer can actually have a mix of the two different types of elements. For example, a consumer could have a surface element configuration with three solid plate plug-in elements and one open coil element for high speed use such as for boiling water.

Figure 11:
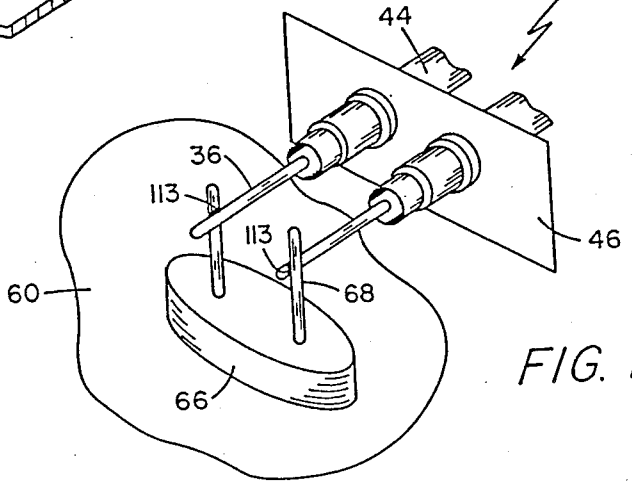
FIG. 11 is a perspective view of an alternate embodiment for connecting the wire ends to the adaptor.

Referring to FIG. 11, there is shown a perspective view of an alternate embodiment for connecting wire ends 68 to conductors 36 of adaptor 34. Rather than using ceramic block terminal 72, welds 113 are provided to rigidly connect conductors 36 of adaptor 34 to respective wire ends 68 from heating wires 58*a–c*. Wire ends 68 rigidly extend in the downward direction and welds 113 rigidly support adaptor 34 in a substantially horizontal plane. It is noted that the embodiments described heretofore have been with reference to a modification of a conventional solid plate heating element to a plug-in unit. More specifically, the wire ends 68 of a conventional solid plate heating element are cut off and an adaptor 34 is connected thereto in order to provide the plug-in feature. It is understood, however, that the inventive principle is also applicable to a redesign of a solid plate heating element rather than the modification thereof. In a redesign, it may be preferable to use a continuous conductor from heating wires 58*a–c* to terminal blades 38. In such case, there would be no need for a junction such as provided by ceramic block terminal 72 or welds 113. Also, in such embodiment, jacket 60 could be eliminated because pan 78 completely encases the underside of the top disk.

This completes the description of the preferred embodiment. However, many modifications and alterations will come to mind to those skilled in the art without departing from the spirit and scope of the invention. Accordingly, it is intended that the scope of the invention be limited only by the appended claims.

What is claimed is:

1. A solid plate plug-in surface heating element adapted for interchangeably plugging into a receptacle for a single open coil plug-in surface heating element, comprising:

a solid plate top;

a resistive heating wire positioned under said solid plate top for generating heat for conduction through said solid plate top;

a pan mounted to an underside of said solid plate top for shielding ends of said resistive heating wire, said pan having a side with at least one hole; and a plug-in adaptor for interconnecting said ends of said resistive heating wire to said receptacle, said adaptor comprising a pair of rigid conductors each having a region surrounded by a coaxial insulator, said adaptor further comprising a brace plate having a pair of apertures, each of said rigid conductors being inserted through a respective one of said apertures with said insulated region being clamped by said respective aperture for holding said rigid conductors in substantially parallel alignment, said brace being mounted to said side of said pan with said rigid conductors extending substantially horizontally outwardly through said at least one hole in said pan, said pair of conductors having inward and outward ends, the inward ends of said pair of conductors respectively being electrically connected to said ends of said resistive heating wire, each of the outward ends of said pair of conductors having a plug-in terminal adapted for plugging into a receptacle for a single open coil plug-in surface heating element.

2. The solid plate plug-in surface heating element recited in claim 1 further comprising means for grounding said solid plate top to an external grounding clip terminal on said receptacle.

3. The solid plate plug-in surface heating element recited in claim 2 wherein said grounding means comprises a grounding bolt coupled from said solid plate top to said pan and a bracket extending from said pan to said grounding clip terminal on said receptacle.

4. The solid plate plug-in surface heating element recited in claim 3 wherein said pan is mounted to said solid plate top by a nut engaging said grounding bolt.

5. A solid plate electric surface heating element adapted for plugging into a receptacle for a shielded spiral wire surface heating element, comprising:

a solid plate top disk having a grounding bolt extending downwardly from the underside thereof;

a resistive electric heating wire attached under said solid plate top disk for providing heat to be conducted through said solid plate top disk;

a pan having a bottom and a side wall with at least one aperture;

means engaging said grounding post for affixing said pan covering the underside of said solid plate top disk, said affixing means electrically connecting said pan to said grounding post;

an adaptor for interconnecting leads of said resistive electric heating wire to said receptacle, said adaptor comprising first and second rigid electrical conductors having electrically insulated regions and a mounting plate having two holes through which said conductors are inserted and securely clamped in substantially parallel alignment, said mounting plate being affixed to said side wall of said pan adjacent said at least one aperture for securing said conductors in a substantially horizontal plane extending through said at least one aperture, said conductors having distal terminals adapted for plugging into said receptacle;

means for connecting inward ends of said rigid conductors to said leads of resistive heating wire; and means for grounding said pan to said receptacle.

6. The solid plate electric surface heating element recited in claim 5 wherein said grounding means comprises a bracket having one end attached to said pan and a distal end having a terminal plate with two holes through which said first and second conductors pass.

7. The solid plate electric surface heating element recited in claim 5 wherein said engaging means comprises an aperture in said pan through which said post extends and a nut tightened on said post for securing said pan against said solid plate top disk.

8. A solid plate electric surface heating element adapted for plugging into a receptacle of a shielded spiral wire surface element having an external spring clip grounding terminal, comprising:

a solid plate top disk having a peripheral rim support and a grounding bolt extending downwardly from an underside of said top disk;

a resistive heating wire embedded in ceramic bonded to the underside of said top disk for providing heat for conduction through said solid plate top disk;

a metal jacket covering a bottom surface of said ceramic on the underside of said disk, said jacket having an insulated port for passing ends of said resistive heating wire;

a pan having a bottom with a hole for receiving said grounding bolt and a side wall with first and second apertures, said pan being mounted under said top disk and encasing said ends of said resistive heating wire, said pan being electrically and mechanically connected to said top disk by a nut tightened up on said grounding bolt;

first and second rigid electrical conductors respectively extending through said first and second apertures in said wall of said pan and having distal plug-in terminals adapted for plugging into said rceptacle, a portion of said first and second electrical conductors having a coating of electrical insulation encased in a metal sleeve;

means for electrically connecting inward ends of said conductors to respective ones of said ends of said resistive heating wire;

means for holding said conductors substantially parallel and for securing said conductors to said pan, said holding and securing means comprising a metal plate having first and second apertures through which said metal sleeves of said respective first and second conductors are inserted, said metal plate being affixed to said pan and holding said conductors in substantially horizontal alignment; and means for electrically connecting said pan to said external spring clip grounding terminal of said receptacle.

9. The heating element recited in claim 8 wherein said means for electrically connecting comprises a bracket connected to said pan at one end and a terminal surrounding said conductors at an opposite end.

10. The heating element recited in claim 9 further comprising a trim ring secured between said rim of said top disk and said pan for supporting said heating element.

* * * * *